United States Patent [19]

Myers

[11] 4,442,418

[45] Apr. 10, 1984

[54] TRIP SOLENOID

[75] Inventor: John L. Myers, Tipp City, Ohio

[73] Assignee: Ledex, Inc., Vandalia, Ohio

[21] Appl. No.: 471,542

[22] Filed: Mar. 2, 1983

Related U.S. Application Data

[63] Continuation-in-part of Ser. No. 259,769, May 1, 1981, abandoned.

[51] Int. Cl.[3] ..... H01F 7/08

[52] U.S. Cl. ..... 335/230; 335/234

[58] Field of Search ..... 335/78, 79, 80, 229, 335/230, 234

[56] References Cited

U.S. PATENT DOCUMENTS 3,755,766 8/1973 Read, Jr. .
3,772,540 11/1973 Benson .
3,886,507 5/1975 Johnston et al. ..... 335/234
3,944,957 3/1976 Kotos et al. .
4,000,481 12/1976 Pang .
4,072,918 2/1978 Read, Jr. .
4,288,771 9/1981 Ueda et al. .

*Primary Examiner*—George Harris
*Attorney, Agent, or Firm*—Biebel, French & Nauman

[57] ABSTRACT

An electric trip solenoid employs a pair of low-cost retaining or holding magnets in an open frame arrangement in which the magnets are positioned on opposite sides of the flat surfaces of a pole and in contact with the pole and the legs of an open frame. The magnets are thickness oriented so as to distribute their flux through relatively large areas avoiding regions of high flux density. In one embodiment the release point may be adjusted by rotating a screw in a closure plate to vary the reluctance of the secondary flux path therethrough.

10 Claims, 4 Drawing Figures

TRIP SOLENOID

RELATED APPLICATION

This application is a continuation-in-part of application Ser. No. 259,769 filed May 1, 1981 now abandoned.

BACKGROUND OF THE INVENTION

This invention relates to trip solenoids and more particularly to a solenoid which employs permanent magnets for retaining an armature in a normally retracted position over long periods of time, and which further include an electric coil which is operated to neutralize or cancel the effective magnetic flux of the magnet and permit the armature to move to a second stable position. The electric coil may also be operated, by reversing the flow of current therethrough, to cause the armature to move or be returned to its first stable position.

Such a trip solenoid, as known in the art, commonly employs an armature which moves through or in a working air gap, or a closing air gap with a fixed pole, and commonly provides a shunt path or a secondary flux path including a fixed air gap. The secondary flux path including the fixed air gap has two purposes. First, it determines the point at which the solenoid will be tripped or released by the application of a given current to the electric coil. Second, it provides a flux path for the electric coil which path is parallel to the flux path provided by the pole and frame through the armature, and protects the permanent magnet from de-magnetization.

Commonly trip solenoids employ a single axially oriented holding magnet which is positioned in the space between a portion of the frame and a fixed pole. Commonly the pole itself is provided with a transversely extending portion or an annular portion which is terminated in proximity to the frame defining an air gap therewith, to provide the shunt path. However, such shunt path is commonly not adjustable with respect to reluctance. Additionally, since the holding magnets are commonly formed of cobalt they are relatively costly.

SUMMARY OF THE INVENTION

The present invention is directed to a trip solenoid which is adapted to employ low cost magnets working through relatively large surface regions so that large areas are provided for flux flow, and the flux concentration or density is maintained at relatively low values. Additionally, the trip solenoid of the present invention provides a variable gap in a secondary or shunt circuit by means of which the release point of the armature may be selected and controlled in relation to the current applied to the electric coil and to other parameters.

In a preferred embodiment of the invention, a generally U-shaped open frame is employed which has flat frame side members. The inside surfaces of the frame sides have large areas and receive flat low-cost permanent magnets to provide the retaining or holding force for the solenoid. A pole piece is received within the frame. The pole piece has cooperating flat surfaces positioned in opposed relation to the inside frame surfaces. The generally flat thickness oriented low-cost magnets, such as ceramic magnets, are received in the spaces between the frame and the pole piece.

One end of the frame, at the end opposed from the armature, is open to receive a closure plate adjacent the pole piece and magnets thereon but is spaced by intermediate non-magnetic material, thereby defining an effective air gap or magnetic flux gap in a secondary or shunt path. Preferably, this gap is variable by suitably selecting the thickness of a shim or spacer as the non-magnetic material.

In another embodiment of the invention, provision has been made for varying the air gap in the secondary circuit by means of a threaded magnetic member received within the closure plate adjacent the pole piece and extending through an opening formed in a non-magnetic shim. By suitably adjusting the position of the threaded member in the closure plate, the effective air gap between the closure plate and the pole piece may be suitably varied for the purpose of controlling the release point of the plunger or armature.

It is accordingly an important object of this invention to provide a low-cost trip solenoid which uses a pair of low-cost thickness oriented magnets.

A further object of the invention is the provision of a trip solenoid having a generally C-shaped or U-shaped frame and having a variable shunt path for determining the operating point of the solenoid.

A still further object of the invention is the provision of a trip solenoid having one or more generally flat permanent magnets therein which distribute the magnetic force over relatively wide areas, to reduce flux concentration in any one locale thus permitting the use of low-cost ceramic magnets in lieu of relatively expensive cobalt-type or the more expensive rare earth magnets.

Another object of the invention is the provision of a trip solenoid, as outlined above, in which the flux path may be modified, by varying an air gap, by means of a simple threaded adjustment. Preferably, the adjustment takes the form of a plug threaded in a closure plate, and normally spaced from the pole piece by a variable distance, defining a variable and controllable air gap.

These and other objects and advantages of the invention will become apparent from the following description, the accompanying drawings and the appended claims.

DESCRIPTION OF PREFERRED EMBODIMENT

Figure 1:
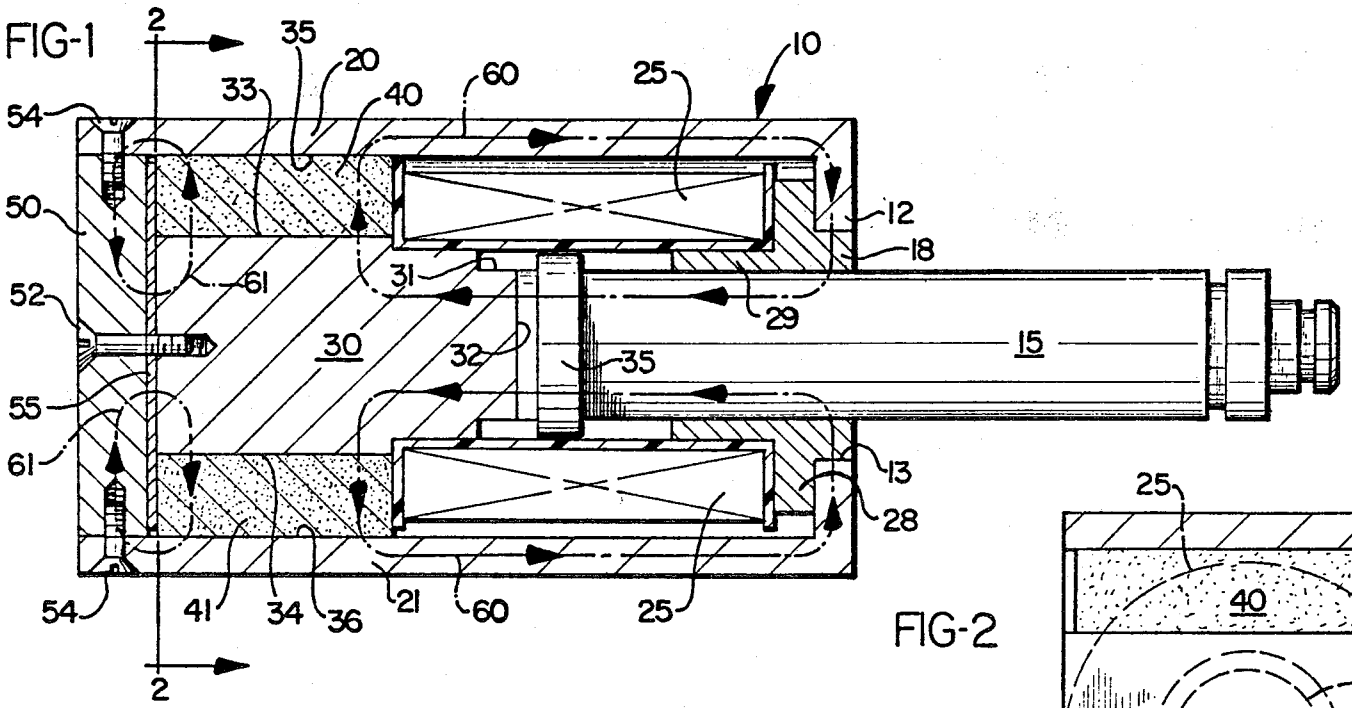
FIG. 1 is a longitudinal sectional view through a trip solenoid in accordance with this invention.
Figure 2:
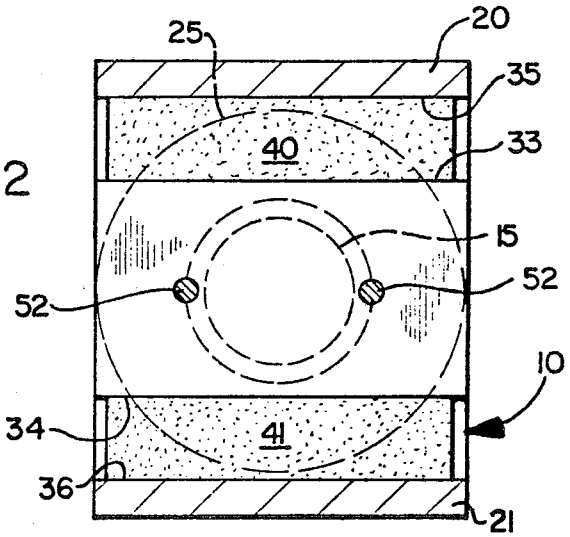
FIG. 2 is a transverse section taken generally along the line 2—2 of FIG. 1.

Referring to the drawings which illustrate preferred embodiments of the invention, a trip solenoid in FIGS. 1 and 2 includes a generally U-shaped open frame 10 formed of soft iron or other suitable ferromagnetic material. The frame 10 is generally U-shaped with a closed forward end 12 defining a circular opening therein 13 through which an armature 15 is received for axial movement in a magnetically conductive sleeve bearing 18. The frame 10 includes a pair of parallel spaced-apart flat frame members 20 and 21.

The sleeve bearing 18 is received in the forward opening of the frame and in effect forms a base for magnetically coupling the armature to the frame. An annular energizing coil 25 is received within the frame 10 and defines a central opening or armature cavity receiving the inner end of the armature 15. The sleeve bearing 18 is flanged as indicated at 28 to abut against the closed end 12 of the frame 10 and extends axially inwardly into the cavity by means of an inwardly extending portion 29 and forms an annular support for another end of the coil 25.

The inner end of the coil 25 is conveniently supported on a fixed pole 30 also formed of a soft iron material. The fixed pole 30 has a cylindrical inner or forward portion 31 received within the cavity of coil 25 and terminating at a generally planar pole face 32. The face 32 forms a working air gap with the inner end of the armature 15 which in FIG. 1, and is shown in the closed position. The armature 15 is provided with a collar 35 movable within the coil cavity providing means defining a stop when the collar 35 engages with the adjacent end of the sleeve 29 to define the moved or tripped position of the armature 15.

The pole 30 extends rearwardly from the cylindrical portion 31 and is provided with opposed flat magnet-receiving surfaces 33 and 34, as best seen in FIG. 2. The surfaces 33 and 34 are spaced from correspondingly opposed inner flat surfaces 35 and 36 of the frame members 20 and 21.

Magnet means for the trip solenoid of this invention include a pair of low-cost generally flat or rectangular ceramic magnets 40 and 41 received respectively between the pole surfaces 33 and 35 on the one hand and the frame surface 34 and 36 on the other hand. The magnets 40 and 41 which are polarized along their shorter dimension, are known as thickness polarized magnets, so that the larger flat areas defined by the top and bottom surfaces respectively of the magnets are the magnet pole faces. When the magnets 40 and 41 are positioned as shown in FIG. 1, they contact comparatively large surface areas of the frame 10 and of the pole 30, so that there is a substantial area across which the flux of the magnet is spread out through the frame and through the pole at relatively low density.

Means defining a secondary shunt path includes a ferromagnetic rear closure member or plate 50 of rectangular shape. The closure plate 50 is proportioned so as to be received in closely spaced relation to the inside surfaces of the ends of frame members 20 and 21 and is supported by bolts 52 in spaced relation to the rear planar surface of the pole 30 by means of one or more spacer shims 55. The plate 50 is also retained by two pairs of bolts 54 extending through the frame members 20 and 21.

The spacer shims 55 are formed of non-magnetic sheet material such as plastic, brass or the like, and may be selected to have a sufficient thickness as to define a magnetic gap of a desired extent for controlling the holding force of the magnets 40 and 41 with respect to the armature 15 or for determining the trip point of the solenoid.

The flux paths formed by the permanent magnets 40 and 41 are illustrated by the broken arrows 60 and 61 in FIG. 1, including a primary flux path 60 through the long portion of the flat frame members 20 and 21, through the end 12 and the bearing 18, through the non-working air gap with the armature 15, through the armature and the cylindrical pole portion 31, the pole 30 and the magnets 40 and 41. A secondary or shunt flux path 61 is provided through the pole 30, the magnets, the frame members 20 and 21 and the rear closure plate 50, the effectiveness of which may be conveniently adjusted by adjusting the thickness of the non-magnetic shims 55 between the plate 50 and the pole 30.

The holding force created by the magnets 40 and 41 is efficiently used in the trip solenoid of this invention, and low-cost ceramic magnets may be used, which retain the armature 15 in its normally retracted position as shown. When it is desired to trip the solenoid, a pulse of electric current is applied to the coil 25 such that the flux through the frame and through the armature and core caused by the magnets is decayed sufficiently to permit the armature to move forward under the influence of a spring or other force. The flux is normally not fully reversed through the magnets themselves and the magnets thus do not become de-energized. When the armature 15 is its forward or moved position, the working gap formed between the armature and the pole face 32 is substantial and the major portion of the flux from the permanent magnets 40 and 41 passes through the closure plate 50 and the variable gap is defined by the shims 55. The coil 25 may also be used conventionally, by reversing the current therethrough, to return the armature to its initial position as shown.

It will thus be seen that an inexpensive and effective trip solenoid is provided by this invention. The variable gap defined by the shims 55 may readily be adjusted to control the tripping point of the solenoid. The employment of a pair of generally rectangular permanent magnets with large flat pole surfaces contacting respectively corresponding flat surfaces of the pole 30 and the frame members 20 and 21 permits the use of low-cost magnets.

Figure 3:
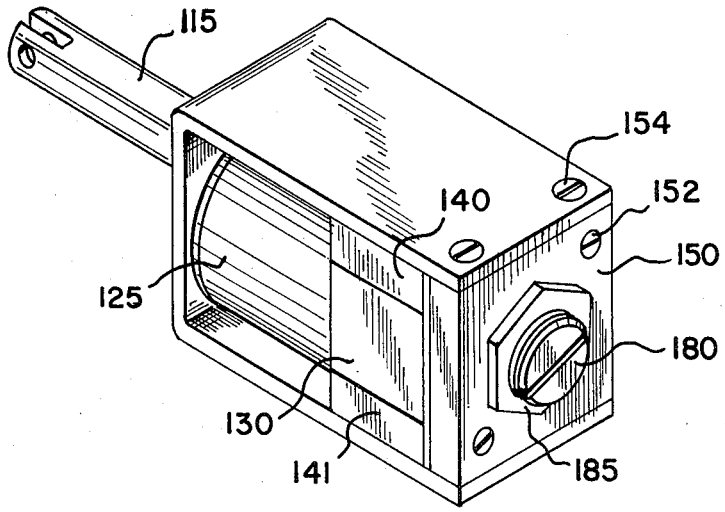
FIG. 3 is a perspective view of a modified form of the invention.
Figure 4:
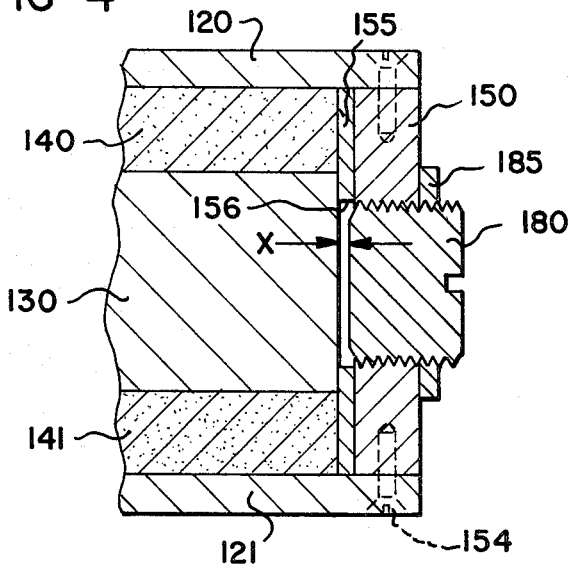
FIG. 4 is a partial enlarged transverse section through the solenoid of FIG. 3.

As mentioned above, the solenoid of this invention includes a further preferred embodiment in which the magnetic coupling or the reluctance between the closure plate and the pole may be more readily varied without the necessity of adding or changing the spacer shims 55. A solenoid made in accordance with this modification is illustrated in FIGS. 3 and 4, in which corresponding parts are marked with corresponding reference numerals plus 100. The solenoid shown in FIG. 3 is substantially identical with that shown in FIGS. 1 and 2 with the exception of the construction of the closure plate 150 and the shim 155. The shim 155 is now apertured at 156 to define a variable or an adjustable gap "X" with a gap adjusting plug or screw 180 received within a threaded opening formed centrally of the plate 150. Thus, the non-magnetic or non-ferrous shim 155 may be made of somewhat thicker material than the shim 55, for example, a thickness of about 0.060 to 0.070". The gap adjusting screw 180, is formed by suitable magnetic material and is accessible from a point externally of the solenoid for manual adjustment. A nose portion of the screw 180 extends into the gap toward the pole 130, but in spaced relation to the pole. The position of the screw 180 may be locked and held by a jamb nut 185 threaded on the outer circumference thereof and jammed against the adjacent back surface of the plate 150. As will be shown in FIG. 4, the diameter of the gap adjusting screw 180 is sufficiently substantial, related to the adjacent surface of the pole 130, to provide a major concentration of flux through the secondary path. Accordingly, the release point of the solenoid may be effectively chosen and then secured by a suitable manual adjustment of the screw 180 to widen or close the gap "X". This has particular advantage in circuit breaker applications, where it is necessary to provide accurate control of the release or trip point of the solenoid.

While the forms of apparatus herein described constitute preferred embodiments of this invention, it is to be understood that the invention is not limited to these precise forms of apparatus, and that changes may be made therein without departing from the scope of the invention.

What is claimed is:

1. An improved trip solenoid comprising:

an open frame, having general parallel frame side members and an end, means in said end defining an opening adapted to receive an armature therethrough, a coil in said frame defining an annular armature cavity, an armature received in said frame opening for axial movement and having an inner end received within said coil cavity, a pole piece mounted in said frame and having a forward portion received in an end of said coil defining a working air gap with said armature and having a rearward portion received exteriorly of said coil and defining a pair of magnet receiving surfaces which are oriented in spaced relation to opposed inside surfaces formed on said frame side members, a pair of thickness oriented magnets, one each received in each of the spaces between said pole surfaces and the adjacent surfaces of said frame members and in contact therebetween for providing an initial holding force tending to retain said armature adjacent said pole piece, and closure plate means receiving in the end of said frame in magnetic contact with said frame members and in spaced relation to said pole piece forming a secondary flux path, through which a major portion of the flux of the coil may pass when energized.

2. The trip solenoid of claim 1 further comprising a non-magnetic shim positioned between said closure plate means and said pole piece defining the magnetic flux gap therebetween.

3. The trip solenoid of claim 1 further comprising means on said armature defining a stop member, a sleeve bearing received in said opening for receiving said armature, said stop member being engageable with said sleeve bearing in a forward position of said armature.

4. The trip solenoid of claim 1 in which said magnets are low-cost ceramic magnets.

5. The trip solenoid of claim 1 further comprising adjustable means in said closure plate means defining a variable air gap with said pole piece for varying the reluctance of said secondary flux path.

6. The solenoid of claim 5 in which said adjustable means comprises a plug threadedly received in said closure plate means and defining with said pole piece a variable air gap, said plug being accessible from a region exteriorly of the solenoid for adjustment, and means retaining said plug in said adjusted position.

7. An improved trip solenoid comprising:

a generally U-shaped frame having spaced generally parallel flat frame side members, a coil in said frame defining an armature cavity, an armature mounted for axial movement on said frame and having an inner end received within said coil cavity, a pole mounted in said frame and having a portion received in an end of said coil defining a working air gap with said armature and having another portion received exteriorly of said coil and defining a pair of flat magnet receiving surfaces which are positioned in spaced relation to opposed flat inside surfaces of said frame members, a pair of rectangular thickness oriented ceramic magnets received in and filling the spaces between said flat pole surfaces and the adjacent inside flat surfaces of said frame members and in contact therebetween for providing an initial holding force tending to retain said armature adjacent said pole piece, a rectangular closure plate in magnetic contact with said frame members, and non-magnetic shim means between said plate and said pole maintaining said plate in spaced relation to said pole forming a secondary flux path through which a major portion of the flux of the coil may pass when energized.

8. The improved trip solenoid of claim 4 further comprising:

a gap adjusting screw formed of magnetic material, means in said closure plate defining a threaded aperture receiving said screw therein with the face of said screw in spaced relation to said pole, and means in said non-magnetic shim defining an opening in alignment with said screw whereby rotation of said screw in said plate varies an air gap defined between the end of said screw and said pole.

9. An improved trip solenoid comprising a frame having spaced frame side members, an electric coil in said frame defining an armature cavity, an armature mounted for axial movement on said frame and having an inner end received within said cavity, a pole mounted in said frame having a portion received within said coil and defining with said armature a working air gap, said pole having another portion exteriorly of said coil and defining a pair of magnet-receiving surfaces positioned in spaced relation to the frame side members, a pair of thickness oriented magnets received within each of the spaces between said pole surfaces and the adjacent surfaces of said frame members and in contact therebetween providing an initial holding force tending to retain said armature adjacent said pole piece, a closure plate in magnetic contact with said frame members and spaced from said pole piece, and means in said closure plate defining an adjustable plug movable toward and away from said pole piece for varying the magnetic coupling through a secondary flux path including said end plate, said magnets, and said pole piece, whereby the release point of said trip solenoid may be adjusted.

10. The solenoid of claim 9 in which said plug is threadedly received in said closure plate with a forward portion thereof in spaced relation to said pole piece defining a secondary air gap which is adjustable with rotation of said plug.

* * * * *